US008974240B2

(12) United States Patent
Yu et al.

(10) Patent No.: US 8,974,240 B2
(45) Date of Patent: Mar. 10, 2015

(54) ELECTRICAL CONNECTOR WITH DETECT PINS

(71) Applicant: Hon Hai Precision Industry Co., Ltd., New Taipei (TW)

(72) Inventors: Chun-Ming Yu, Kunshan (CN); Kai-Gang Yu, Kunshan (CN); Ji-Chao Wang, Kunshan (CN); Guo-Hua Zhang, Kunshan (CN); Qi-Sheng Zheng, Kunshan (CN); Terrance F. Little, Fullerton, CA (US); Stephen Sedio, Valley Center, CA (US); An-Jen Yang, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 22 days.

(21) Appl. No.: 13/865,948

(22) Filed: Apr. 18, 2013

(65) Prior Publication Data

US 2014/0315405 A1 Oct. 23, 2014

(51) Int. Cl.
*H01R 13/703* (2006.01)

(52) U.S. Cl.
CPC ..... *H01R 13/7032* (2013.01)
USPC ..... 439/188

(58) Field of Classification Search
USPC ..... 439/188, 489, 660, 639
See application file for complete search history.

(56) References Cited

U.S. PATENT DOCUMENTS

| | | | | |
|---|---|---|---|---|
| 7,833,065 | B2 * | 11/2010 | Lin et al. | 439/639 |
| 8,317,528 | B2 * | 11/2012 | Chen et al. | 439/188 |
| 8,690,608 | B2 * | 4/2014 | Naito et al. | 439/660 |
| 8,711,552 | B2 * | 4/2014 | Medica et al. | 361/679.02 |
| 8,747,147 | B2 * | 6/2014 | Yu et al. | 439/489 |
| 2009/0111330 | A1 * | 4/2009 | Lin et al. | 439/638 |
| 2012/0021629 | A1 * | 1/2012 | Chen et al. | 439/188 |
| 2012/0322282 | A1 * | 12/2012 | Naito et al. | 439/137 |
| 2013/0115826 | A1 * | 5/2013 | Sloey et al. | 439/690 |
| 2013/0149910 | A1 * | 6/2013 | Ko | 439/660 |
| 2013/0183852 | A1 * | 7/2013 | Rostami | 439/502 |
| 2013/0196544 | A1 * | 8/2013 | Little et al. | 439/626 |
| 2013/0210251 | A1 * | 8/2013 | Little et al. | 439/188 |
| 2013/0225010 | A1 * | 8/2013 | Naito | 439/676 |
| 2014/0051274 | A1 * | 2/2014 | Yu et al. | 439/188 |
| 2014/0051303 | A1 * | 2/2014 | Yu et al. | 439/660 |
| 2014/0120778 | A1 * | 5/2014 | Yu et al. | 439/660 |

* cited by examiner

*Primary Examiner* — Alexander Gilman
(74) *Attorney, Agent, or Firm* — Wei Te Chung; Ming Chieh Chang

(57) ABSTRACT

An electrical connector comprises an insulative housing, a metallic shell surround the insulative housing, a plurality of contacts and two detect modules retained to the metallic shell. The insulative housing is formed with a base and a tongue extending forwardly from the base. The shell and the insulative housing define a receiving cavity therebetween. The detect module have a detect pin, respectively, the detect pins extend into the receiving cavity through the shell and electrically connecting with each other via a shell of a mating plug.

14 Claims, 7 Drawing Sheets

ELECTRICAL CONNECTOR WITH DETECT PINS

BACKGROUND OF THE INVENTION

1. Field of the Invention

The present invention relates to an electrical connector, and more particular to an electrical connector with detect pins for indicating insertion of a mating plug therein.

2. Description of the Related Art

USB PD (power delivery) receptacle and plug are developed to enhance a power delivery function for USB products. The USB PD plug has a longer shell relative to traditional plug, so PD detect pins disposed on the USB PD receptacle can be actuated by a front edge of an inserted part of the longer shell of the USB PD plug, while not by the traditional plug. However, the PD detect pins of current USB PD receptacle in USB PD specification needs to occupy a center of the bottom of the receiving space along a top to bottom direction, it may not be adapted for a sink type or stacked type connector.

An improved connector with detect pins is needed.

SUMMARY OF THE INVENTION

Accordingly, an object of the present invention is to provide an electrical connector with detect pins.

In order to achieve the object set forth, an electrical connector, adapted for receiving a mating plug with a shell, comprises an insulative housing formed with a base and a mating tongue extending forwardly from the base; a metallic shell covering the insulative housing thereby defining a receiving cavity surrounding the mating tongue for receiving the mating plug; and a plurality of conductive contacts retained to the insulative housing. Two detect pins extend into the receiving cavity and have two detecting portions disposed on two opposite sides of the mating tongue, respectively, both the two detect pins are located at a rear of the receiving cavity and are capable of electrically connecting with each other via the shell of the mating plug.

Other objects, advantages and novel features of the invention will become more apparent from the following detailed description of the present embodiment when taken in conjunction with the accompanying drawings.

DETAILED DESCRIPTION OF THE INVENTION

Figure 1:
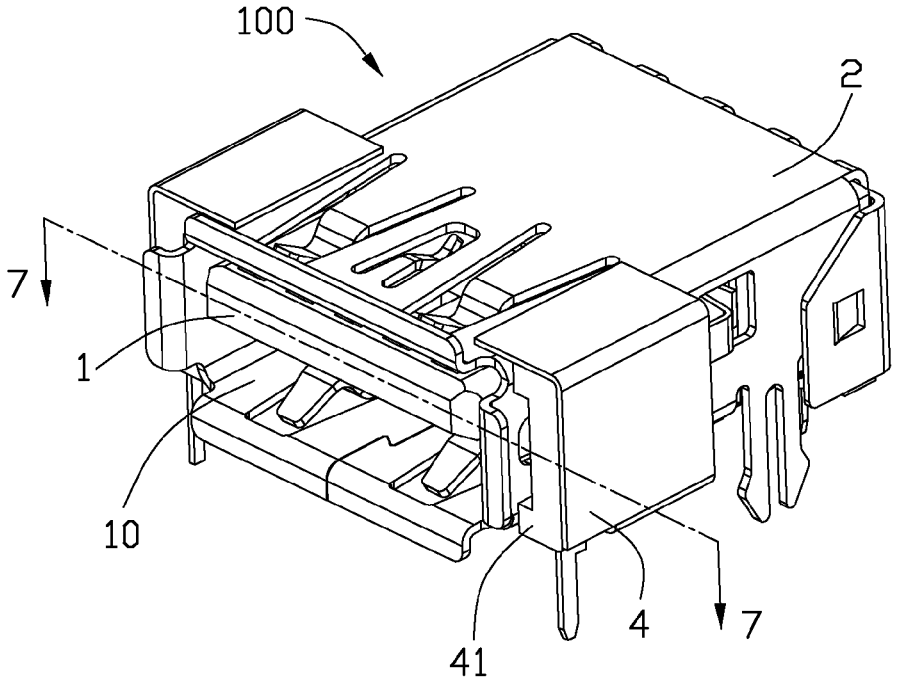
FIG. 1 is an assembled, perspective view of an electrical connector in accordance with the present invention.

Reference will be made to the drawing figures to describe the present invention in detail, wherein depicted elements are not necessarily shown to scale and wherein like or similar elements are designated by same or similar reference numeral through the several views and same or similar terminology.

Figure 2:
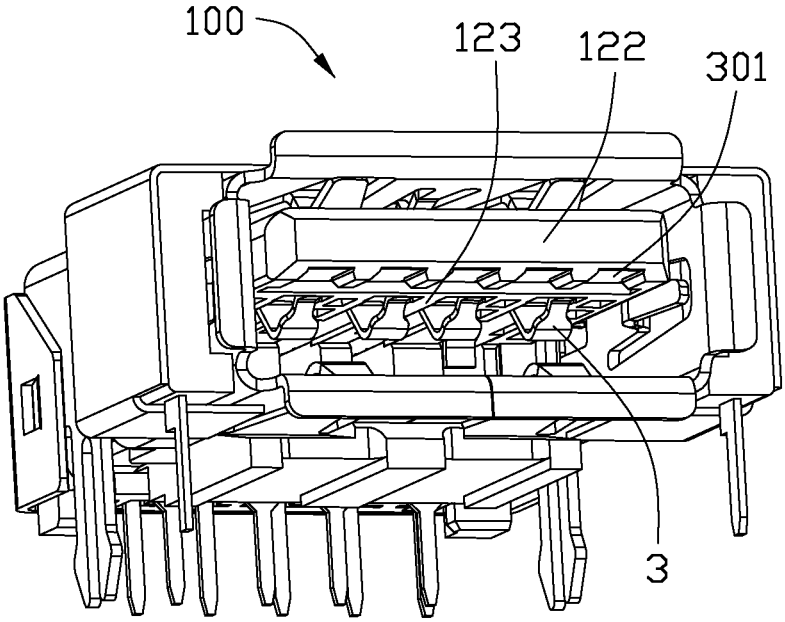
FIG. 2 is similar with FIG. 1, taken from another side.
Figure 3:
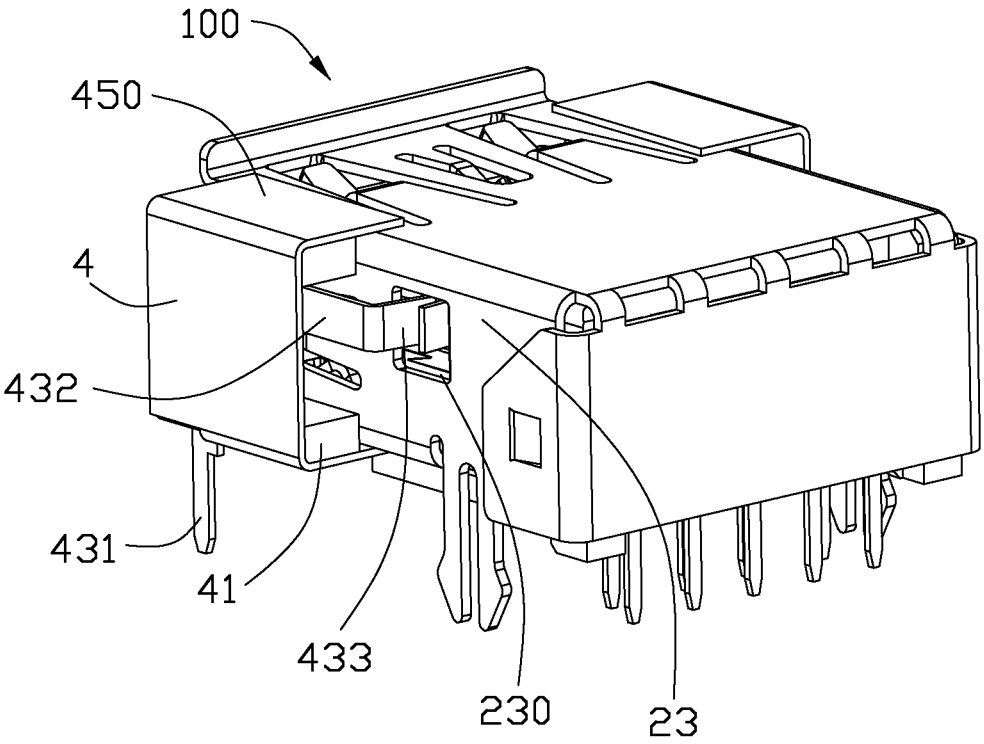
FIG. 3 is another assembled, perspective view of the electrical connector shown in FIG. 1.

Referring to FIG. 1 to FIG. 3, an electrical connector 100 in accordance with an embodiment of the present invention is provided and configured as a USB 3.0 PD receptacle, it should be pointed out that the other similar electrical connectors, such as USB 2.0 connector, eSATA connector, Display Port connector and et al, are also suitable for incorporation of the present invention. The electrical connector 100 has a substantial same configuration as that of USB 3.0 receptacle except detect pins thereof. A conventional USB 3.0 receptacle are described in detail in many patents, such as U.S. Pat. No. 7,625,243, the disclosure of which are incorporated herein by reference to the extent not inconsistent herewith.

The electrical connector 100 comprises an insulative housing 1, and a metallic shell 2 surrounding the insulative housing 1 and defining a receiving cavity 10 cooperatively with the insulative housing 1. A plurality of conductive contacts 3 are retained to the insulative housing 1. The receiving cavity 10 defines an insertion direction along a front-to-back direction. Two detect modules 4 are assembled to two opposite sides of the shell 2 and outside the receiving cavity 10.

Figure 4:
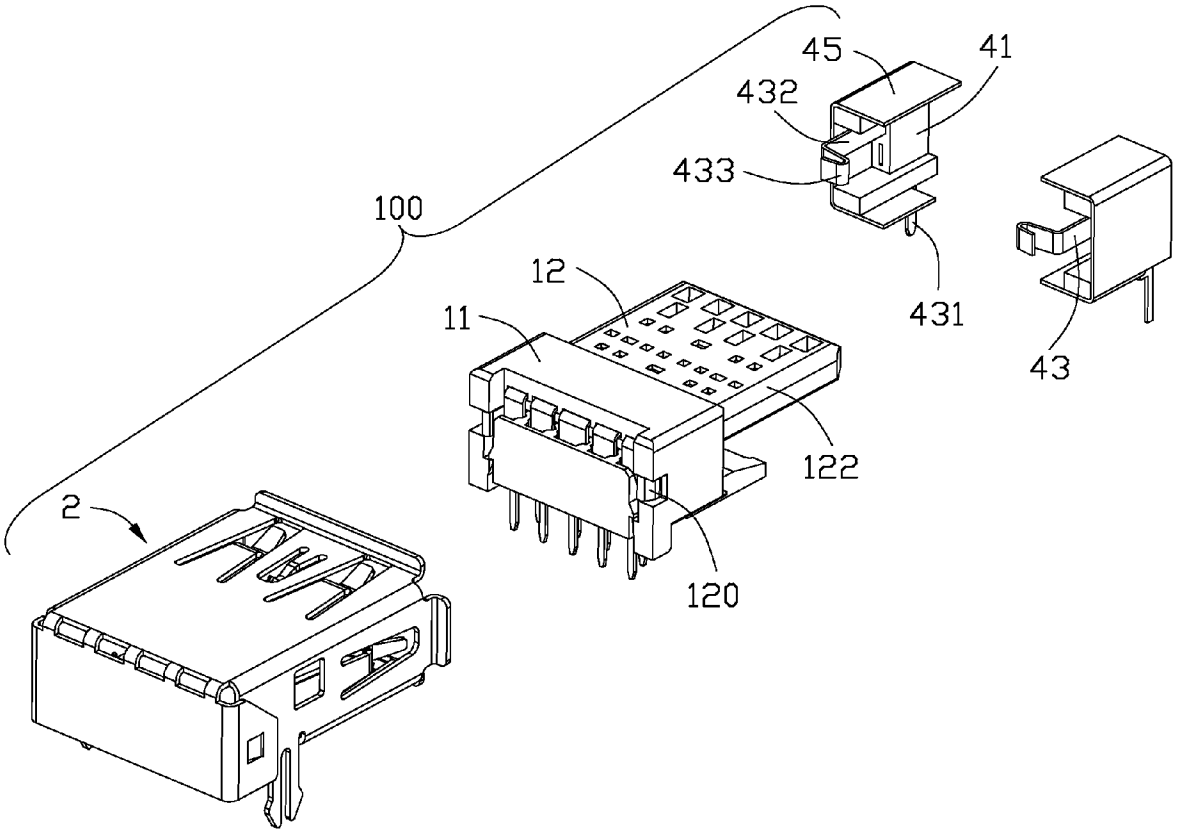
FIG. 4 is a partially assembled perspective view of the electrical connector in FIG. 3.
Figure 5:
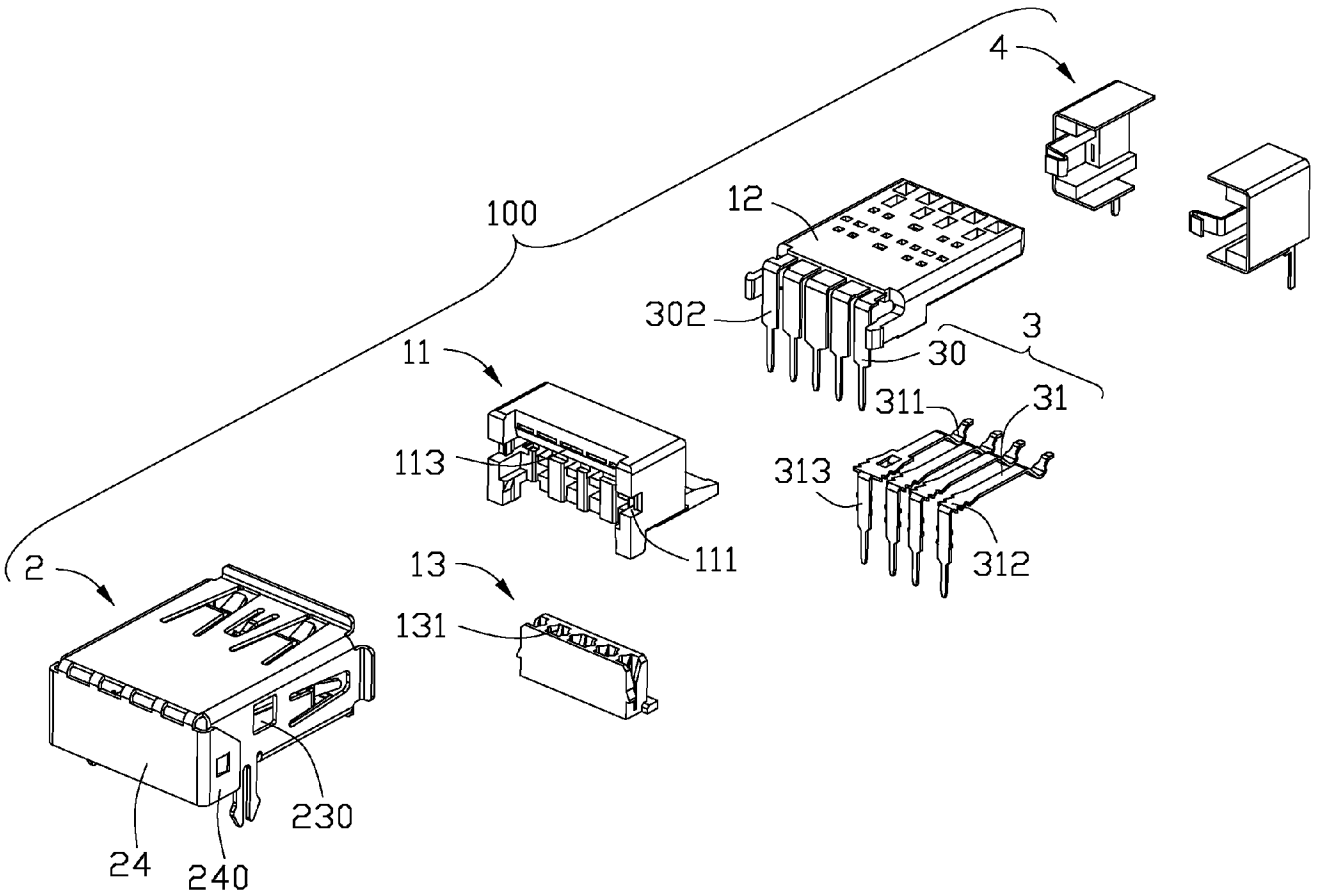
FIG. 5 is a partially exploded, perspective view of the electrical connector in FIG. 3.
Figure 6:
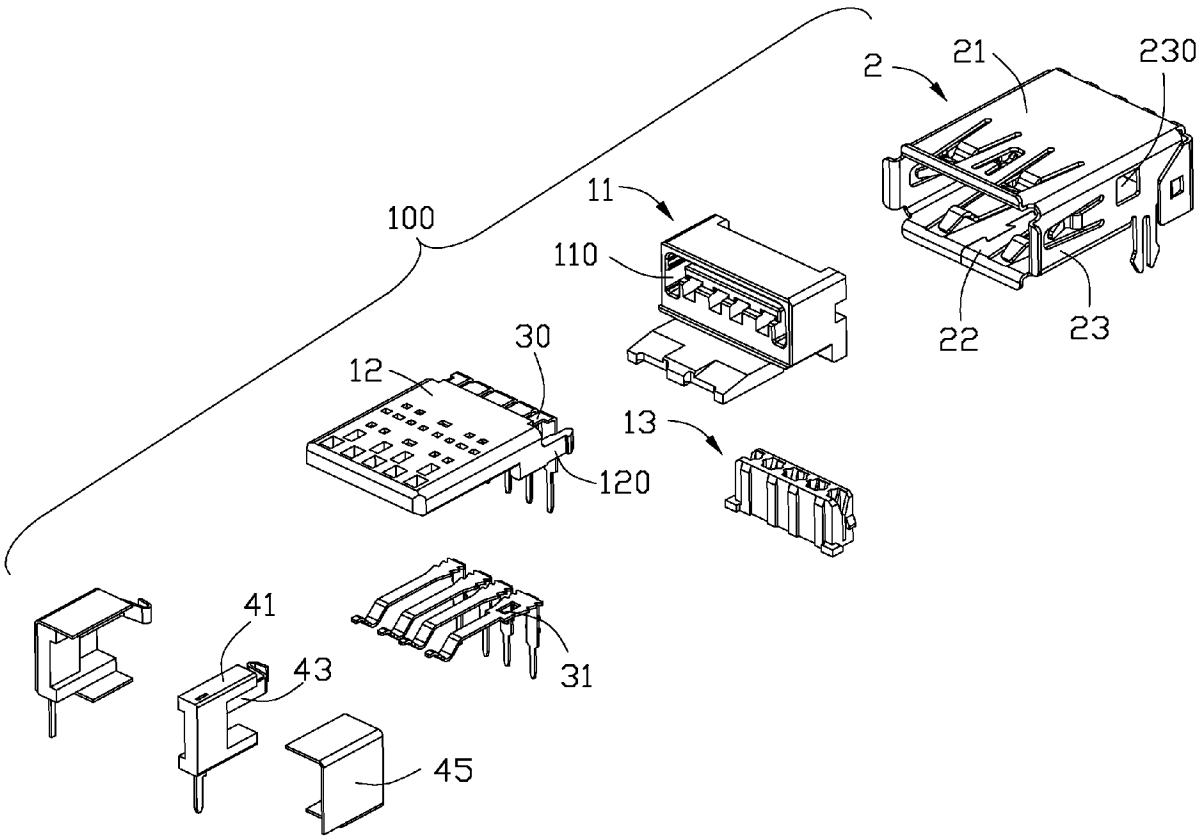
FIG. 6 another partially exploded, perspective view of the electrical connector in FIG. 6.
Figure 7:
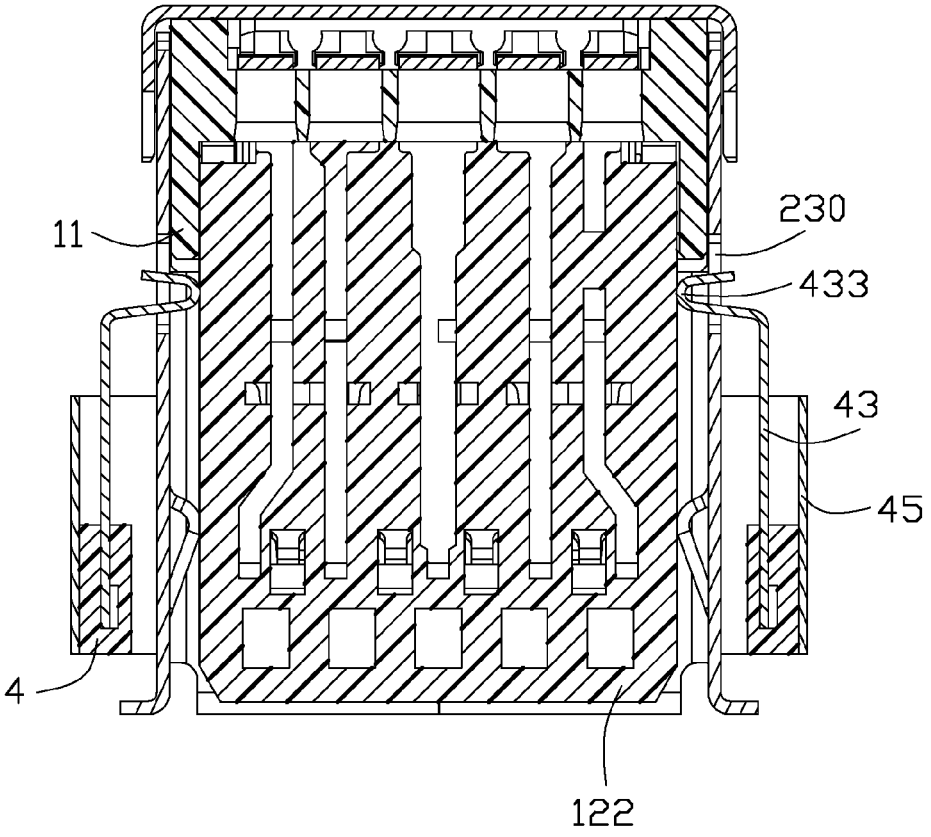
FIG. 7 is a cross sectional view of the electrical connector, taken along line 7-7 in FIG. 1.

FIGS. 4-6 illustrate exploded configuration of the electrical connector 100 in present embodiment, the insulative housing 1 comprises a base 11, a tongue 12 assembled to the base 11 and extending forwardly from the base 11 and a spacer 13 assembled to a rear of the base 11, in alternative embodiment, the base 11 and the tongue 12 also may be integrated. The conductive contacts 3 consist of nine pins, five first contacts 30 and four second contacts 31, which are jointly compliance to USB 3.0 standard.

The base 11 defines a groove 110 therethrough along a front-to-back direction, the tongue 12 is backwardly inserted into the groove 110 of the base 11, two latching arms 120 extend rearward from a rear end of the tongue 12 and lock with notches 111 formed on a rear of the base 11 to retain the tongue 12 to the base 11. The tongue 12 has a mating tongue 122 extending forwardly beyond the base 11 to be exposed in the receiving cavity 10.

Conjoined with FIG. 2, all of the first contacts 30 and the second contacts 31 are disposed on a bottom face 123 of the mating tongue 122. The first contacts 30 are insert-molded with the tongue 12 and each have a planar first contacting portion 301 arranged in a front row near a port of the receiving cavity 10. Each of the first contacts 30 has a tail portion 302 bent downwardly to be soldered to a printed circuit board. The second contacts 31 are assembled to the base 11 and extend forwardly.

Each of the second contacts 31 has an arched second contacting portion 311 floatablely received in slots 122 defined in the tongue 12 and arranged in a rear row on the tongue 12 behind the front row of the first contacting portions 301. Each of the second contacts 31 has a retaining portion 312 interfering with the base 11 and a tail portion 313 bent downwardly from the retaining portion 312 to be soldered to the printed circuit board. The tail portions 302 of the first contacts 30 are initially kept in horizontal plane, then pass through a plurality of passageways 113 defined on the base 11 when the tongue 12 is assembled to the base 11, and finally are bent downwardly. The spacer 13 defines a plurality of slots 131 for receiving the tail portions 302 of the first contacts 30.

Referring to FIGS. 5-6, the metallic shell 2 is made by stamping of a metal sheet and is configured with a top wall 21, a bottom wall 22, two opposite side walls 23, and a rear wall 24. The metallic shell 2 surrounds the insulative housing 1 and defines the receiving cavity 10 therein for receiving the USB plug therein. The rear wall 24 comprises two locking arms 240 to lock with the side walls 23. Each of the side walls 23 defines an opening 230 outside a rear end of the receiving cavity 10.

Referring to FIGS. 4-7, the two detect modules 4 have a same configuration, each includes an insulative clump 41 insert molded with a detect pin 43 and a metallic plate 45 covering a top, a bottom and an outside faces of the insulative clump 41. The detect pin 43 is formed in an L-shaped, including a vertical leg 431, a mounting part 432 horizontally and backwardly extending from a top end of the leg 431 and beyond the insulative clump 41, and a detecting portion 433 on a rear end of the mounting part 432. The vertical leg 431, and the mounting part 432 are located in a same plane, and the detecting portion 433 is bent from the mounting part 432 inwardly then outwardly to form an arched shape.

Conjoined with FIGS. 1-3, the detect modules 4 are assembled to front ends of the two side walls 23, respectively, the insulative clump 41 abuts against an outside face of the side wall 23, the metallic plate 45 has an upper and a lower horizontal pieces 450, which are attached to the top wall 21 and the bottom wall 22 of the shell 2 by soldering or gluing, respectively, so as to retain the detect module 4 to the shell 2. Further conjoined with FIG. 7, the detecting portions 433 of the detect pins 43 pass through the openings 230 into the receiving cavity 10, and are located on two opposite sides of the mating tongue 122, even inwardly abut against the mating tongue 122. The detecting portions 433 are aligned with each other along a direction and substantially located in a same horizontal plane as the mating tongue 122, that means the detecting portions 433 do not occupy a bottom spacer under the mating tongue 122, so this detect module 4 is adapted for both sink type and stacked type connectr.

The electrical connector 100 can mate with a conventional USB plug, a USB PD plug whose shell has a longer mating part and thin card. When the conventional USB plug is inserted, the detecting portion 433 of the detect pin 43 keep unmoved since a corresponding mating part of the conventional USB plug is not long enough to touch the detecting potion 433. While the shell of an inserted USB PD plug can touch the detect portions 433 of the detect pins 43, then the two detecting portions 433 electrically connect each other via the shell of the USB PD plug. A status of corresponding detect circuit (not shown, may be designed in the printed circuit board) shifts from "open" to "close", to indicate that an USB PD Plug is inserted, a big power supply may begin.

When the thin card is inserted, the detecting portions 433 may be pushed by an insulative cover but will not electrically conduct with each other. So, only the USB PD plug can activate the detect circuit. In another embodiment, maybe only one detect member is provided, and the detect circuit is established between the detect pin and the shell 2 of the electrical connector 100 via the shell of the USB PD plug.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, adapted for receiving a mating plug with a shell comprising:

an insulative housing formed with a base and a mating tongue extending forwardly from the base;

a metallic shell covering the insulative housing thereby defining a receiving cavity surrounding the mating tongue for receiving the mating plug;

a plurality of conductive contacts retained to the insulative housing; and two detect pins extending into the receiving cavity and having two detecting portions disposed on two opposite sides of the mating tongue, respectively, both the two detect pins being located at a rear of the receiving cavity and being capable of electrically connecting with each other via the shell of the mating plug, wherein the electrical connector further comprising two detect modules, each detect module has an insulative clump with the detect pin, and a cover covering the insulative clump;

wherein the detect modules are attached to two opposite sides of the metallic shell and outside the receiving cavity except the detecting portions;

wherein the shell has a top wall and a bottom wall, the cover of the detect module has two horizontal pieces attached to the top wall and the bottom wall, respectively.

2. The electrical connector as described in claim 1, wherein the detect pin has a vertical leg, and a mounting part horizontally and backwardly extending from a top end of the leg and beyond the insulative clump, and the detecting portion is formed on a rear end of the mounting part, the vertical leg and the mounting part are located in a same plane, the detecting portion is bent from the mounting part inwardly then outwardly to form an arched shape.

3. The electrical connector as described in claim 1, wherein the shell has two opposite side walls, each side wall defines an opening, the detecting portion passes through the opening into the receiving cavity.

4. The electrical connector as described in claim 1, wherein the insulative housing has a base and a tongue assembled to the base, the base defines a groove therethrough along a front-to-back direction, the tongue is backwardly inserted into the groove of the base, and the tongue has two latching arms at a rear end thereof to lock with the base.

5. The electrical connector as described in claim 1, wherein the electrical connector is a USB 3.0 connector, the conductive contacts has nine pins whose contacting portion arranged in a front row and a rear row, and the contacting portion in the front row is a planar first contacting portion, the contacting portion in the rear row is an arched second contacting portion.

6. An electrical connector, adapted for receiving a mating plug with a shell comprising:

an insulative housing with a plurality of contacts formed with a base and a mating tongue extending forwardly from the base;

a metallic shell defining a top wall, a bottom wall and two opposite side walls connecting the top and the bottom walls, these walls cooperatively defining a receiving cavity surrounding the mating tongue for receiving the mating plug; and a detect module assembled and fastened to the shell, the detect module has an insulative clump retained with a detect pin, the detect pin having a detecting portion extending into the receiving cavity through the shell from outside for contacting with the shell of the mating plug, wherein the shell has two opposite side walls with an opening, the detecting portion passes through the opening into the receiving cavity.

7. The electrical connector as described in claim 6, further comprising another detect module, the two detect modules are fastened to two opposite sides of the metallic shell and near a front of the metallic shell.

8. The electrical connector as described in claim 7, wherein the detect pin has a vertical leg, and a mounting part horizontally and backwardly extending from a top end of the leg and beyond the insulative clump, and the detecting portion is formed on a rear end of the mounting part, the vertical leg and the mounting part are located in a same plane, the detecting portion is bent from the mounting part inwardly then outwardly to form an arched shape.

9. The electrical connector as described in claim 8, wherein the detect module has a cover covering the insulative clump.

10. The electrical connector as described in claim 9, wherein the shell has a top wall and a bottom wall, the cover of the detect module has two horizontal pieces attached to the top wall and the bottom wall, respectively.

11. An electrical connector for selective use with a shorter plug, a long plug and an electrical card, comprising:

an insulative housing enclosed in a metallic shell to commonly define a mating port;

a mating tongue located in the mating port;

a plurality of contacts disposed in the housing with contacting sections exposed upon the mating tongue; and a pair of detect pins defining corresponding contacting sections respectively exposed around a rearmost portion of the mating port; wherein during mating, said pair of detect pins are able to be electrically connected via a metallic shell of said longer plug while a metallic shell of the shorter plug extends with an insufficient distance and can not reach and connect the pair of detect pins, and the electronic card can touch the pair of detect pins while being able electrically connect the pair of detect pins due to dielectric thereof, wherein said pair of detect pins are respectively located by two lateral sides of the metallic shell which defines corresponding openings to allow the detect pins to extend therethrough into the mating port.

12. The electrical connector as claimed in claim 11, wherein said metallic shell defines a pair of spring fingers, on said two lateral sides, extending into the mating port in front of said pair of detect pins.

13. The electrical connector as claimed in claim 11, wherein each of said detect pins is associated within an insulative clump to form a module.

14. The electrical connector as claimed in claim 12, wherein said insulative clump is enclosed in a metallic plate which directly contacting the metallic shell.

* * * * *